US008496194B2

(12) United States Patent
Baltz

(10) Patent No.: US 8,496,194 B2
(45) Date of Patent: Jul. 30, 2013

(54) METHOD AND APPARATUS FOR RETAINING HIGHLY TORQUED FITTINGS IN MOLDED RESIN OR POLYMER HOUSING

(75) Inventor: James P. Baltz, Waterville, OH (US)

(73) Assignee: Finishing Brands Holdings Inc., Toledo, OH (US)

( * ) Notice: Subject to any disclaimer, the term of this patent is extended or adjusted under 35 U.S.C. 154(b) by 265 days.

(21) Appl. No.: 12/045,354

(22) Filed: Mar. 10, 2008

(65) Prior Publication Data

US 2009/0224083 A1 Sep. 10, 2009

(51) Int. Cl.
*B05B 5/00* (2006.01)

(52) U.S. Cl.
USPC ..... 239/690; 239/289; 239/525; 239/526; 239/600; 239/704; 239/708

(58) Field of Classification Search
USPC ..... 239/690–708, 600, 289, 525, 526
See application file for complete search history.

(56) References Cited

U.S. PATENT DOCUMENTS

| | | | |
|---|---|---|---|
| 2,057,434 | A | 10/1936 | Jaden et al. |
| 3,169,882 | A | 2/1965 | Juvinall et al. |
| 3,169,883 | A | 2/1965 | Juvinall |
| 3,557,821 | A | 1/1971 | Siegel et al. |
| 3,653,592 | A | 4/1972 | Cowan |
| 3,932,071 | A | 1/1976 | Schaedler |
| 3,940,061 | A | 2/1976 | Gimple et al. |
| 3,949,266 | A | 4/1976 | Vogts et al. |
| 3,964,683 | A | 6/1976 | Gimple |
| 3,990,609 | A | 11/1976 | Grant |
| 4,001,935 | A | 1/1977 | Krohn et al. |
| 4,002,777 | A | 1/1977 | Juvinall et al. |
| 4,020,393 | A | 4/1977 | Porter |
| 4,030,857 | A | 6/1977 | Smith, Jr. |
| 4,037,561 | A | 7/1977 | LaFave et al. |
| 4,066,041 | A | 1/1978 | Buschor et al. |
| 4,081,904 | A | 4/1978 | Krohn et al. |
| 4,105,164 | A | 8/1978 | Lau et al. |
| 4,116,364 | A | 9/1978 | Culbertson et al. |
| 4,122,327 | A | 10/1978 | Vogts et al. |
| 4,133,483 | A | 1/1979 | Henderson |
| 4,144,564 | A | 3/1979 | Lamb |
| D252,097 | S | 6/1979 | Probst et al. |

(Continued)

FOREIGN PATENT DOCUMENTS

| | | | |
|---|---|---|---|
| EP | 0 734 777 | A2 | 10/1996 |
| GB | 2 053 029 | A1 | 2/1981 |

(Continued)

OTHER PUBLICATIONS

"REA-IV and REA-IVL Delta Electrostatic Spray Guns, Dual Atomization Technology", Service Manual, ITW Ransburg Electrostatic Systems, 1998, 27 pages, Addendum, 2005, 4 pages.

(Continued)

*Primary Examiner* — Steven J Ganey
(74) *Attorney, Agent, or Firm* — Barnes & Thornburg LLP

(57) ABSTRACT

A module for mounting on the end of a handle of a coating material dispensing device comprises at least a coating material fitting for coupling to a source of coating material. The module further includes a first fractional module component and a second fractional module component. The coating material fitting is captured between the first fractional module component and the second fractional module component when the first and second fractional module components are assembled together.

20 Claims, 2 Drawing Sheets

U.S. PATENT DOCUMENTS

| | | | | |
|---|---|---|---|---|
| 4,165,022 | A | 8/1979 | Bentley et al. | |
| 4,169,545 | A | 10/1979 | Decker | |
| 4,171,100 | A | 10/1979 | Benedek et al. | |
| 4,174,070 | A | 11/1979 | Lau et al. | |
| 4,174,071 | A | 11/1979 | Lau et al. | |
| 4,214,709 | A | 7/1980 | Scull et al. | |
| 4,216,915 | A | 8/1980 | Hengartner et al. | |
| 4,219,865 | A | 8/1980 | Malcolm | |
| 4,248,386 | A | 2/1981 | Morle | |
| 4,266,721 | A | 5/1981 | Sickles | |
| 4,285,446 | A | 8/1981 | Rapp et al. | |
| 4,289,278 | A | 9/1981 | Itoh | |
| 4,290,091 | A | 9/1981 | Malcolm | |
| 4,331,298 | A | 5/1982 | Bentley et al. | |
| RE30,968 | E | 6/1982 | Grant | |
| 4,361,283 | A | 11/1982 | Hetherington et al. | |
| 4,377,838 | A | 3/1983 | Levey et al. | |
| D270,179 | S | 8/1983 | Grime | |
| D270,180 | S | 8/1983 | Grime | |
| D270,367 | S | 8/1983 | Grime | |
| D270,368 | S | 8/1983 | Grime | |
| 4,401,268 | A | 8/1983 | Pomponi, Jr. | |
| 4,433,812 | A | 2/1984 | Grime | |
| 4,437,614 | A | 3/1984 | Garcowski | |
| 4,453,670 | A | 6/1984 | Sirovy | |
| 4,462,061 | A | 7/1984 | Mommsen | |
| 4,483,483 | A | 11/1984 | Grime | |
| 4,491,276 | A | 1/1985 | Reeves | |
| 4,513,913 | A | 4/1985 | Smith | |
| 4,529,131 | A | 7/1985 | Rutz | |
| 4,537,357 | A | 8/1985 | Culbertson et al. | |
| 4,567,911 | A | 2/1986 | Kedem | |
| 4,572,438 | A | 2/1986 | Traylor | |
| 4,606,501 | A | 8/1986 | Bate et al. | |
| 4,613,082 | A | 9/1986 | Gimple et al. | |
| D287,266 | S | 12/1986 | Knetl et al. | |
| 4,702,420 | A | 10/1987 | Rath | |
| 4,747,546 | A | 5/1988 | Talacko | |
| 4,752,034 | A * | 6/1988 | Kuhn et al. | 239/690 |
| 4,759,502 | A | 7/1988 | Pomponi, Jr. et al. | |
| 4,760,962 | A | 8/1988 | Wheeler | |
| 4,770,117 | A | 9/1988 | Hetherington et al. | |
| 4,819,879 | A | 4/1989 | Sharpless et al. | |
| 4,828,218 | A | 5/1989 | Medlock | |
| 4,844,342 | A | 7/1989 | Foley | |
| D303,139 | S | 8/1989 | Morgan | |
| D305,057 | S | 12/1989 | Morgan | |
| 4,890,190 | A | 12/1989 | Hemming | |
| D305,452 | S | 1/1990 | Morgan | |
| D305,453 | S | 1/1990 | Morgan | |
| 4,911,367 | A | 3/1990 | Lasley | |
| 4,921,172 | A | 5/1990 | Beimain et al. | |
| 4,927,079 | A | 5/1990 | Smith | |
| 4,934,603 | A | 6/1990 | Lasley | |
| 4,934,607 | A * | 6/1990 | Lasley | 239/691 |
| D313,064 | S | 12/1990 | Lind et al. | |
| 4,978,075 | A | 12/1990 | Lind et al. | |
| 4,993,645 | A | 2/1991 | Buschor | |
| 5,022,590 | A | 6/1991 | Buschor | |
| D318,712 | S | 7/1991 | Buschor | |
| 5,039,019 | A | 8/1991 | Weinstein et al. | |
| 5,054,687 | A | 10/1991 | Burns et al. | |
| 5,056,720 | A * | 10/1991 | Crum et al. | 239/698 |
| 5,063,350 | A | 11/1991 | Hemming et al. | |
| 5,064,119 | A | 11/1991 | Mellette | |
| 5,073,709 | A | 12/1991 | Lunzer et al. | |
| 5,074,466 | A | 12/1991 | Santiago | |
| 5,080,289 | A | 1/1992 | Lunzer | |
| 5,090,623 | A | 2/1992 | Burns et al. | |
| 5,093,625 | A | 3/1992 | Lunzer | |
| D325,241 | S | 4/1992 | Buschor | |
| 5,118,080 | A | 6/1992 | Hartmann | |
| 5,119,992 | A | 6/1992 | Grime | |
| 5,178,330 | A | 1/1993 | Rodgers | |
| 5,180,104 | A | 1/1993 | Mellette | |
| 5,209,365 | A | 5/1993 | Wood | |
| 5,209,405 | A | 5/1993 | Robinson et al. | |
| 5,209,740 | A | 5/1993 | Bryant et al. | |
| 5,218,305 | A | 6/1993 | Lunzer | |
| 5,235,228 | A | 8/1993 | Nakanura et al. | |
| 5,236,129 | A | 8/1993 | Grime et al. | |
| 5,236,425 | A | 8/1993 | Kurtz et al. | |
| 5,284,299 | A | 2/1994 | Medlock | |
| 5,284,301 | A | 2/1994 | Kieffer | |
| 5,289,974 | A | 3/1994 | Grime et al. | |
| 5,289,977 | A | 3/1994 | Lind et al. | |
| 5,299,740 | A | 4/1994 | Bert | |
| 5,303,865 | A | 4/1994 | Bert | |
| 5,330,108 | A | 7/1994 | Grime et al. | |
| 5,332,156 | A | 7/1994 | Wheeler | |
| 5,332,159 | A | 7/1994 | Grime et al. | |
| D349,387 | S | 8/1994 | Crabbe | |
| D349,559 | S | 8/1994 | Vanderhoef et al. | |
| 5,334,876 | A | 8/1994 | Washeleski et al. | |
| D350,387 | S | 9/1994 | Feitel et al. | |
| 5,351,887 | A | 10/1994 | Heterington et al. | |
| 5,395,054 | A | 3/1995 | Wheeler | |
| 5,400,971 | A | 3/1995 | Maugans et al. | |
| 5,402,940 | A * | 4/1995 | Haller et al. | 239/697 |
| 5,553,788 | A | 9/1996 | Del Gaone et al. | |
| 5,582,350 | A | 12/1996 | Kosmyna et al. | |
| 5,618,001 | A | 4/1997 | Del Gaone et al. | |
| 5,639,027 | A | 6/1997 | Fritz | |
| 5,644,461 | A | 7/1997 | Miller et al. | |
| 5,647,543 | A | 7/1997 | Ma | |
| RE35,769 | E | 4/1998 | Grime et al. | |
| 5,759,271 | A * | 6/1998 | Buschor | 118/308 |
| 5,803,313 | A | 9/1998 | Flatt et al. | |
| 5,829,679 | A | 11/1998 | Strong | |
| 5,836,517 | A | 11/1998 | Burns et al. | |
| 5,957,395 | A | 9/1999 | Howe et al. | |
| RE36,378 | E | 11/1999 | Mellette | |
| 6,179,223 | B1 | 1/2001 | Sherman et al. | |
| 6,189,809 | B1 | 2/2001 | Schwebemeyer | |
| 6,276,616 | B1 | 8/2001 | Jenkins | |
| 6,402,058 | B2 | 6/2002 | Kaneko et al. | |
| 6,417,595 | B1 | 7/2002 | Wasson | |
| 6,425,761 | B1 | 7/2002 | Eibofner | |
| 6,460,787 | B1 | 10/2002 | Hartle et al. | |
| 6,488,264 | B2 | 12/2002 | Wiklund | |
| 6,522,039 | B1 * | 2/2003 | Baltz et al. | 310/88 |
| 6,572,029 | B1 | 6/2003 | Holt | |
| 6,622,948 | B1 * | 9/2003 | Haas et al. | 239/706 |
| 6,669,112 | B2 | 12/2003 | Reetz, III et al. | |
| 6,679,193 | B2 | 1/2004 | Shutic et al. | |
| 6,698,670 | B1 | 3/2004 | Gosis et al. | |
| 6,712,292 | B1 | 3/2004 | Gosis et al. | |
| RE38,526 | E | 6/2004 | Hansinger et al. | |
| 6,758,425 | B2 | 7/2004 | Michael | |
| 6,776,362 | B2 | 8/2004 | Kawamoto et al. | |
| 6,790,285 | B2 | 9/2004 | Matsumoto | |
| 6,796,519 | B1 | 9/2004 | Knobbe et al. | |
| 6,817,553 | B2 | 11/2004 | Steur | |
| 6,854,672 | B2 | 2/2005 | Allen | |
| 6,877,681 | B2 | 4/2005 | Hartle et al. | |
| 6,916,023 | B2 | 7/2005 | Alexander et al. | |
| 6,929,698 | B2 | 8/2005 | Shutic et al. | |
| 6,951,309 | B2 | 10/2005 | Buschor et al. | |
| 6,955,724 | B2 | 10/2005 | Dankert | |
| 6,975,050 | B2 | 12/2005 | Cleanthous et al. | |
| 7,058,291 | B2 | 6/2006 | Weaver et al. | |
| 7,128,277 | B2 | 10/2006 | Schaupp | |
| 7,143,963 | B2 | 12/2006 | Tani et al. | |
| 7,166,164 | B2 | 1/2007 | Shutic et al. | |
| 7,217,442 | B2 | 5/2007 | Wilt et al. | |
| 7,247,205 | B2 | 7/2007 | Shutic et al. | |
| 7,292,322 | B2 | 11/2007 | Boroditsky et al. | |
| 7,296,759 | B2 | 11/2007 | Alexander et al. | |
| 7,296,760 | B2 | 11/2007 | Alexander et al. | |
| 7,621,471 | B2 | 11/2009 | Howe | |
| 7,757,973 | B2 | 7/2010 | Alexander et al. | |
| 2003/0006322 | A1 | 1/2003 | Hartle et al. | |
| 2003/0151320 | A1 | 8/2003 | Poon et al. | |
| 2004/0195405 | A1 | 10/2004 | Healy | |
| 2006/0081729 | A1 | 4/2006 | Nagai | |
| 2006/0219824 | A1 | 10/2006 | Alexander et al. | |

| | | | |
|---|---|---|---|
| 2006/0283386 | A1 | 12/2006 | Alexander et al. |
| 2008/0286458 | A1 | 11/2008 | Kirchoff |
| 2009/0058209 | A1 | 3/2009 | Baranowski et al. |

FOREIGN PATENT DOCUMENTS

| | | | |
|---|---|---|---|
| GB | 1 597 349 | | 9/1981 |
| GB | 2 153 260 | A | 8/1985 |
| KR | 10-0807151 | B1 | 4/2008 |
| WO | 01/85353 | A1 | 11/2001 |
| WO | 2005/014177 | A1 | 2/2005 |
| WO | 2006/107935 | A1 | 10/2006 |
| WO | 2008/039016 | A1 | 4/2008 |

OTHER PUBLICATIONS

"Automatic R-E-A III Electrostatic Spray or R-E-A III-L Electrostatic HVLP Spray", ITW Ransburg Electrostatic Systems, 1996, 2 pages.

"Automatic R-E-M Air-Assisted Airless Electrostatic Spray Gun", ITW Ransburg Electrostatic Systems, 1995, 2 pages.

REA-90A and REA-90LA Automatic Electrostatic Spray Guns, Service Manual, ITW Ransburg, 2006, 44 pages.

"M90 Handguns", Service Manual, Ransburg, 2005, 48 pages.

R-E-A 70 Hand Gun Interim Service Manual, Model 72074, Ransburg Electrostatic Equipment, Incorporated, Feb. 1985, 3 pages.

R-E-A 70 Electrostatic Paint Finishing System from Ransburg Electrostatic Equipment, Inc., Factory Mutual Research Corporation, May 19, 1986, 3 pages.

Official action from U.S. Appl. No. 12/045,155 dated Aug. 13, 2009.

Official action from U.S. Appl. No. 12/045,354 dated Feb. 25, 2010.

Official action from U.S. Appl. No. 12/045,173 dated Mar. 19, 2010.

Official action from U.S. Appl. No. 12/045,169 dated Apr. 14, 2010.

Official action from U.S. Appl. No. 12/045,178 dated May 13, 2010.

International search report from PCT/US2209/035242 dated May 19, 2009, 14 pages.

Written opinion from PCT/US2009/035411 dated Jun. 9, 2009, 10 pages.

International search report and written opinion from PCT/US2009/035439, dated Jun. 5, 2009, 12 pages.

International search report and written opinion from PCT/US2009/035720, dated Jun. 3, 2009, 12 pages.

International search report and written opinion from PCT/US2009/035485, dated Jun. 10, 2009, 12 pages.

Official action from related CA 2,717,822 dated Mar. 22, 2012, 4 pages.

* cited by examiner

METHOD AND APPARATUS FOR RETAINING HIGHLY TORQUED FITTINGS IN MOLDED RESIN OR POLYMER HOUSING

CROSS-REFERENCE TO RELATED APPLICATIONS

This application is related to U.S. Ser. No. 12/045,155 filed Mar. 10, 2008, titled Sealed Electrical Source For Air-Powered Electrostatic Atomizing And Dispensing Device, U.S. Pat. No. 7,988,075, issued Aug. 2, 2011, titled Circuit Board Configuration For Air-Powered Electrostatically Aided Coating Material Atomizer, U.S. Pat. No. 8,016,213, issued Sep. 13, 2011, titled Controlling Temperature In Air-Powered Electrostatically Aided Coating Material Atomizer, U.S. Ser. No. 12/045,169, filed Mar. 10, 2008, titled Circuit For Displaying The Relative Voltage At The Output Electrode Of An Electrostatically Aided Coating Material Atomizer, and U.S. Pat. No. 7,926,748, issued Apr. 19, 2011, titled Generator For Air-Powered Electrostatically Aided Coating Dispensing Device, the disclosures of all of which are hereby incorporated herein by reference.

FIELD OF THE INVENTION

This invention relates to methods for constructing molded filled or unfilled resin and polymer housings which are provided with fittings subject to relatively high torque during assembly and/or use. The invention is disclosed in the context of electrostatically aided coating material atomization and dispensing devices, hereinafter sometimes called spray guns or guns; and particularly in the context of a spray gun powered by compressed gas, typically compressed air. Hereinafter, such guns are sometimes called cordless spray guns or cordless guns.

BACKGROUND

Various types of manual and automatic spray guns are known. There are the cordless electrostatic handguns illustrated and described in U.S. Pat. Nos. 4,219,865; 4,290,091; 4,377,838; and, 4,491,276. There are also, for example, the automatic and manual spray guns illustrated and described in the following listed U.S. patents and published applications: 2006/0283386; 2006/0219824; 2006/0081729; 2004/0195405; 2003/0006322; U.S. Pat. Nos. 7,296,760; 7,296,759; 7,292,322; 7,247,205; 7,217,442; 7,166,164; 7,143,963; 7,128,277; 6,955,724; 6,951,309; 6,929,698; 6,916,023; 6,877,681; 6,854,672; 6,817,553; 6,796,519; 6,790,285; 6,776,362; 6,758,425; RE38,526; 6,712,292; 6,698,670; 6,679,193; 6,669,112; 6,572,029; 6,488,264; 6,460,787; 6,402,058; RE36,378; 6,276,616; 6,189,809; 6,179,223; 5,836,517; 5,829,679; 5,803,313; RE35,769; 5,647,543; 5,639,027; 5,618,001; 5,582,350; 5,553,788; 5,400,971; 5,395,054; D350,387; D349,559; 5,351,887; 5,332,159; 5,332,156; 5,330,108; 5,303,865; 5,299,740; 5,289,977; 5,289,974; 5,284,301; 5,284,299; 5,236,425; 5,236,129; 5,218,305; 5,209,405; 5,209,365; 5,178,330; 5,119,992; 5,118,080; 5,180,104; D325,241; 5,093,625; 5,090,623; 5,080,289; 5,074,466; 5,073,709; 5,064,119; 5,063,350; 5,054,687; 5,039,019; D318,712; 5,022,590; 4,993,645; 4,978,075; 4,934,607; 4,934,603; D313,064; 4,927,079; 4,921,172; 4,911,367; D305,453; D305,452; D305,057; D303,139; 4,890,190; 4,844,342; 4,828,218; 4,819,879; 4,770,117; 4,760,962; 4,759,502; 4,747,546; 4,702,420; 4,613,082; 4,606,501; 4,572,438; 4,567,911; D287,266; 4,537,357; 4,529,131; 4,513,913; 4,483,483; 4,453,670; 4,437,614; 4,433,812; 4,401,268; 4,361,283; D270,368; D270,367; D270,180; D270,179; RE30,968; 4,331,298; 4,289,278; 4,285,446; 4,266,721; 4,248,386; 4,216,915; 4,214,709; 4,174,071; 4,174,070; 4,171,100; 4,169,545; 4,165,022; D252,097; 4,133,483; 4,122,327; 4,116,364; 4,114,564; 4,105,164; 4,081,904; 4,066,041; 4,037,561; 4,030,857; 4,020,393; 4,002,777; 4,001,935; 3,990,609; 3,964,683; 3,949,266; 3,940,061; 3,932,071; 3,557,821; 3,169,883; and, 3,169,882. There are also the disclosures of WO 2005/014177 and WO 01/85353. There are also the disclosures of EP 0 734 777 and GB 2 153 260. There are also the Ransburg model REA 3, REA 4, REA 70, REA 90, REM and M-90 guns, all available from ITW Ransburg, 320 Phillips Avenue, Toledo, Ohio, 43612-1493.

The disclosures of these references are hereby incorporated herein by reference. The above listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a module for attachment to a tool comprising a first fractional module component and a second fractional module component, at least one fitting captured between the first and second fractional module components when the first and second fractional module components are assembled together.

Illustratively according to this aspect of the invention, each of the first and second fractional module components includes a feature complementarily configured to receive the at least one at least one fitting in the assembled module.

Illustratively according to this aspect of the invention, the tool comprises a coating material dispensing device. The at least one at least one fitting includes both a coating material fitting and a compressed gas fitting. Each of the first and second fractional module components includes a feature complementarily configured to receive the coating material fitting and the compressed gas fitting in the assembled module.

Illustratively according to this aspect of the invention, both the coating material fitting and the compressed gas fitting comprise metallic fittings. The first and second fractional module components are assembled together with metallic fasteners. The module further includes a feature provided in at least one of the first and second fractional module components to accommodate an electrically conductive device for connecting to the metallic fittings and metallic fasteners by at least one of: pressing of the electrically conductive device into intimate contact with the metallic fittings; pressing of the electrically conductive device into intimate contact with the metallic fasteners; electrical conductors extending between the electrically conductive device and the metallic fittings; and, electrical conductors extending between the electrically conductive device and the metallic fasteners.

Further illustratively according to this aspect of the invention, the module includes a length of grounded conduit coupled to the compressed gas fitting and to ground to ground the electrically conductive device and the metallic fittings and metallic fasteners coupled to the electrically conductive device.

Further illustratively according to this aspect of the invention, the module includes a generator having a shaft. A compressed gas driven turbine wheel is mounted on the shaft for driving the generator.

Further illustratively according to this aspect of the invention, the module includes a passageway provided in at least one of the first and second fractional module components to supply compressed gas to the turbine wheel to drive the generator to produce electricity for the coating material dispensing device.

Illustratively according to this aspect of the invention, each of the first and second fractional module components includes a first feature and a second feature configured to receive the first feature in the assembled module.

Illustratively according to this aspect of the invention, the module is adapted to mount on a free end of a handle of a somewhat pistol-shaped coating material dispensing device. Each of the first and second fractional module components includes a feature which cooperates with the feature on the other of the first and second fractional module components to receive a second feature provided on the free end of the handle to aid in orienting the assembled module relative to the handle.

Illustratively according to this aspect of the invention, the first and second fractional module components are joined together in the assembled module by threaded fasteners received in cooperating passageways provided in the first and second fractional module components.

Illustratively according to this aspect of the invention, a space is provided between the cooperating passageways for a module-to-handle threaded fastener.

Further illustratively according to this aspect of the invention, the module includes a generator having a shaft. A compressed gas driven turbine wheel is mounted on the shaft for driving the generator.

Further illustratively according to this aspect of the invention, the module includes a passageway provided in at least one of the first and second fractional module components to supply compressed gas to the turbine wheel to drive the generator to produce electricity for the tool.

According to another aspect of the invention, a module for mounting on the end of a handle of a coating material dispensing device comprises at least a coating material fitting for coupling to a source of coating material. The module further includes a first fractional module component and a second fractional module component. The coating material fitting is captured between the first fractional module component and the second fractional module component when the first and second fractional module components are assembled together.

Illustratively according to this aspect of the invention, the source of coating material comprises a source of liquid coating material. The module further includes a compressed gas fitting. A source of compressed air is coupled to the compressed gas fitting.

Illustratively according to this aspect of the invention, each of the first and second fractional module components includes a feature complementarily configured to receive the coating material fitting and the compressed gas fitting in the assembled module.

Illustratively according to this aspect of the invention, both the coating material fitting and the compressed gas fitting comprise metallic fittings. The first and second fractional module components are assembled together with metallic fasteners. The module further includes a feature provided in at least one of the first and second fractional module components to accommodate an electrically conductive device for connecting to the metallic fittings and metallic fasteners by at least one of: pressing of the electrically conductive device into intimate contact with the metallic fittings; pressing of the electrically conductive device into intimate contact with the metallic fasteners; electrical conductors extending between the electrically conductive device and the metallic fittings; and, electrical conductors extending between the electrically conductive device and the metallic fasteners.

Further illustratively according to this aspect of the invention, the module includes a length of grounded conduit coupled to the compressed gas fitting and to ground to ground the electrically conductive device and the metallic fittings and metallic fasteners coupled to the electrically conductive device.

Illustratively according to this aspect of the invention, each of the first and second fractional module components includes a first feature and a second feature configured to receive the first feature in the assembled module.

Illustratively according to this aspect of the invention, the first and second fractional module components are joined together in the assembled module by threaded fasteners received in cooperating passageways provided in the first and second fractional module components.

Illustratively according to this aspect of the invention, a space is provided between the cooperating passageways for a module-to-handle threaded fastener.

Further illustratively according to this aspect of the invention, the module includes a generator having a shaft. A compressed gas driven turbine wheel is mounted on the shaft for driving the generator.

Further illustratively according to this aspect of the invention, the module includes a passageway provided in at least one of the first and second fractional module components to supply compressed gas to the turbine wheel to drive the generator to produce electricity for the coating material dispensing device.

DETAILED DESCRIPTIONS OF ILLUSTRATIVE EMBODIMENTS

In many prior art guns, the air and fluid fittings necessary for gun operation are molded in place in a single molded component. The complexity resulting from the modular design of the illustrated gun reduced the likelihood that a mold could be made that would produce the module as designed. Further, if the compressed gas and coating material fittings were integral, non-removable components of the module, the entire module would have to be discarded if, for example, coating material hardened in the coating material fitting and could not be removed. Also, if both fittings were incorporated into a single composite fitting, the weight of an all stainless steel coating material/compressed gas fitting was a concern from the operator fatigue standpoint.

The coating material and compressed gas fittings on a typical gun are subject to installation and removal torques as delivery conduits are attached and detached. Two metallic fittings must be held in place, transport their respective coating material and compressed gas, and not rotate in the gun body or module, or fail catastrophically as delivery conduits are attached and detached. This system also must be able to withstand the stress the delivery conduits, typically flexible hoses, place on the fittings and the gun where the fittings enter the gun.

The module was split into fractional components, and the coating material and compressed gas fittings are installed after molding by capturing them between the fractional components.

Figure 1:
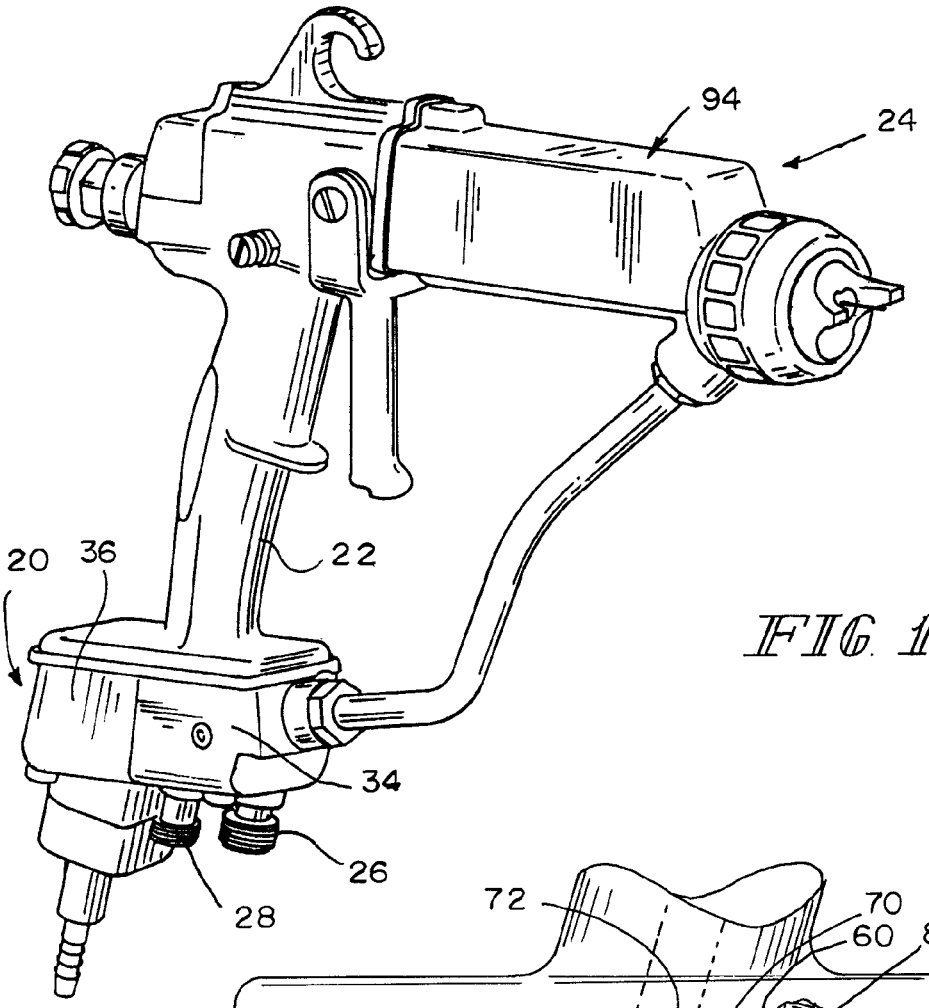
FIG. 1 illustrates a perspective view, generally from the right front, of a gun constructed according to the invention.
Figure 2:
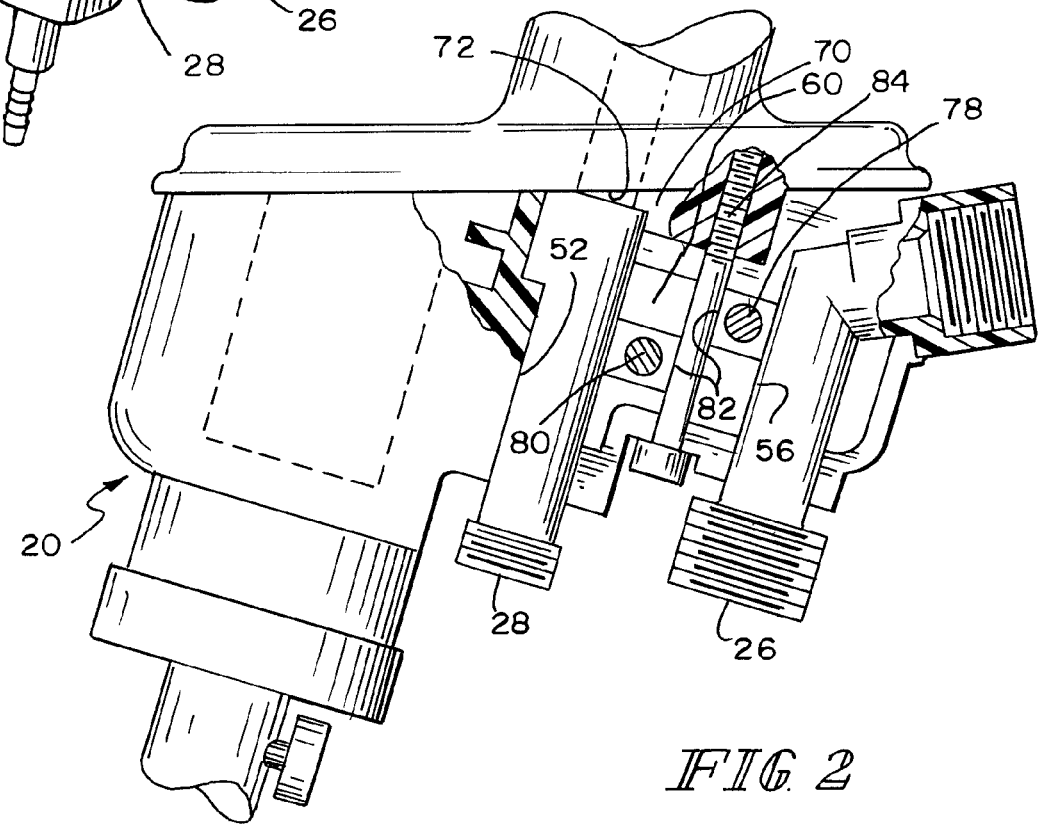
FIG. 2 illustrates a partly longitudinally sectional fragmentary side elevational view of certain details of the gun illustrated in FIG. 1.
Figures 3, 4:
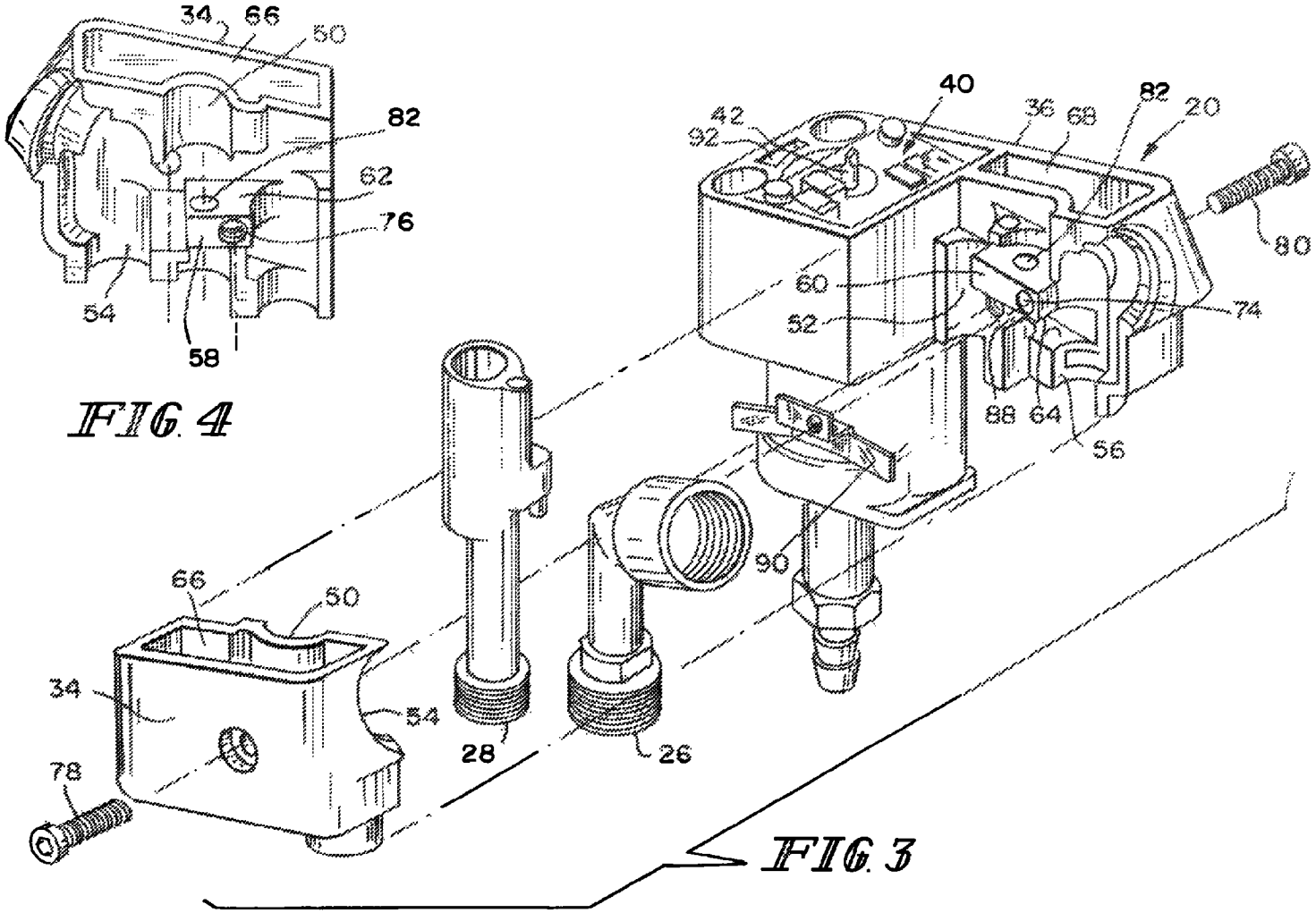
FIG. 3 illustrates an exploded perspective view of certain details of the gun illustrated in FIG. 1; and, FIG. 4 illustrates a perspective view of a detail of the gun illustrated in FIG. 1.

Referring now particularly to FIG. 1, a power module assembly 20 mounts on the lower end of a handle 22 of a spray gun 24. Module 20 is coupled through coating material and compressed gas fittings 26, 28, respectively, to sources of coating material and compressed gas (not shown). In the illustrated embodiment, the coating material source is a source of liquid paint and the compressed gas source is a source of compressed air. Coating material fitting 26 illustratively is constructed from stainless steel which is relatively inert to the coating material being dispensed through it. Compressed gas fitting 28 illustratively is fabricated from aluminum.

Module 20 is comprised of a fractional (hereinafter sometimes one-quarter or/1;4) power module component 34 and a fractional (hereinafter sometimes three-quarter or/3;4) power module component 36. Each of fractional power module components 34, 36 illustratively is constructed from a filled or unfilled molded resin or polymer such as, for example, PolyOne GMF 60640 UV black 28, black, UV stabilized, glass-reinforced, mineral-filled, type 6 Nylon. Coating material fitting 26 and compressed gas fitting 28 are captured between fractional power module component 34 and fractional power module component 36 when components 34, 36 are assembled together, as will be discussed in more detail. Module 20 also includes a voltage control switch (not shown), a printed circuit board assembly 40, a three-phase, fractional horsepower motor 42 operated as a generator and powered by a compressed air driven turbine wheel (not shown), all for the purposes set forth in related U.S. Ser. No. 12/045,155 filed Mar. 10, 2008, titled Sealed Electrical Source For Air-Powered Electrostatic Atomizing And Dispensing Device, U.S. Pat. No. 7,988,075, issued Aug. 2, 2011, titled Circuit Board Configuration For Air-Powered Electrostatically Aided Coating Material Atomizer, U.S. Pat. No. 8,016,213, issued Sep. 13, 2011, titled Controlling Temperature In Air-Powered Electrostatically Aided Coating Material Atomizer, U.S. Ser. No. 12/045,169, filed Mar. 10, 2008, titled Circuit For Displaying The Relative Voltage At The Output Electrode Of An Electrostatically Aided Coating Material Atomizer, and U.S. Pat. No. 7,926,748, issued Apr. 19, 2011, titled Generator For Air-Powered Electrostatically Aided Coating Dispensing Device.

Each of fractional power module component 34 and fractional power module component 36 includes a contoured pocket 50, 52, respectively, complementarily configured to receive the compressed gas fitting 28 in the assembled power module 20. Each of fractional power module component 34 and fractional power module component 36 also includes a contoured pocket 54, 56, respectively, complementarily configured to receive the coating material fitting 26 in the assembled power module 20.

Each of fractional power module component 34 and fractional power module component 36 includes a tongue 58, 60, respectively, and, adjacent the tongue 58, 60, a groove 62, 64 configured to receive the tongue 60, 58 of the other of fractional power module component 36 and fractional power module component 34, respectively, in the assembled power module 20.

Each of fractional power module component 34 and fractional power module component 36 includes a contoured pocket 66, 68, respectively, which cooperates with the contoured pocket 68, 66 on the other of fractional power module component 36, 34, respectively, to receive a boss 70 provided on the bottom end 72 of the gun 24 handle 22 and aid in properly orienting the assembled module 20 relative to the handle 22. Cross holes 74, 76 provided with screw threads by, for example, Heli-Coil® screw thread inserts, are provided for receiving threaded fasteners 78, 80, respectively, such as Allen head cap screws, to hold the assembled fractional power module components 34, 36 together in the assembled power module 20. Between the cross holes 74, 76 is a clearance diameter 82 for module 20-to-handle 22 bolt 84, which again may be an Allen head cap screw.

A pocket 88 is provided in fractional power module component 36 to accommodate an electrically conductive, illustratively, stainless steel, grounding clip 90 for connecting to all of the metallic fittings, such as fittings 26, 28, and metallic fasteners, such as fasteners 78, 80, 84, either by pressing into intimate contact with these components or by electrical conductors extending between these components and clip 90. The ground may then be achieved, for example, by providing a length of grounded hose to the compressed gas fitting 28. (A) passageway(s) 92 is (are) also molded into one or both of fractional power module components 34, 36 to supply compressed gas to turbine wheel (not shown) to drive motor/generator 42 to produce electricity which is regulated by circuitry on PC board assembly 40 and supplied through (a) suitable conductor(s) up handle 22 to a high voltage cascade assembly of any suitable configuration housed in the barrel 94 of gun 24.

What is claimed is:

1. A module adapted to mount on a free end of a handle of a pistol-shaped coating material dispensing device, the module comprising a first fractional module component and a second fractional module component, at least one fitting captured between the first and second fractional module components when the first and second fractional module components are assembled together, each of the first and second fractional module components including a first pocket which cooperates with the first pocket on the other of the first and second fractional module components to receive a boss provided on the free end of the handle to aid in orienting the assembled module relative to the handle, each of the first and second fractional module components further including a tongue and a groove configured to receive the tongue in the assembled module.

2. The module of claim 1 wherein each of the first and second fractional module components includes a second pocket complementarily configured to receive the at least one fitting in the assembled module.

3. The module of claim 2 wherein the at least one fitting includes both a coating material fitting and a compressed gas fitting, each of the first and second fractional module components including a second pocket complementarily configured to receive the coating material fitting and a third pocket complementarily configured to receive the compressed gas fitting in the assembled module.

4. The module of claim 3 wherein both the coating material fitting and the compressed gas fitting comprise metallic fittings, the first and second fractional module components are assembled together with metallic fasteners, the module further including a fourth pocket provided in at least one of the first and second fractional module components to accommodate an electrically conductive device for connecting to the metallic fittings and metallic fasteners by at least one of pressing of the electrically conductive device into intimate contact with the metallic fittings and metallic fasteners and electrical conductors extending between the electrically conductive device and the metallic fittings and metallic fasteners.

5. The module of claim 4 further including a length of grounded conduit coupled to the compressed gas fitting and to ground to ground the electrically conductive device and the metallic fittings and metallic fasteners coupled to the electrically conductive device.

6. The module of claim 3 further including a generator having a shaft, and a compressed gas driven turbine wheel mounted on the shaft for driving the generator.

7. The module of claim 6 further including a passageway provided in at least one of the first and second fractional module components to supply compressed gas to the turbine wheel to drive the generator to produce electricity for the coating material dispensing device.

8. The module of claim 1 further including a generator having a shaft, and a compressed gas driven turbine wheel mounted on the shaft for driving the generator.

9. The module of claim 8 further including a passageway provided in at least one of the first and second fractional module components to supply compressed gas to the turbine wheel to drive the generator to produce electricity for the tool.

10. A module adapted to mount on a free end of a handle of a pistol-shaped coating material dispensing device, the module comprising a first fractional module component and a second fractional module component, at least one fitting captured between the first and second fractional module components when the first and second fractional module components are assembled together, each of the first and second fractional module components including a first pocket which cooperates with the first pocket on the other of the first and second fractional module components to receive a boss provided on the free end of the handle to aid in orienting the assembled module relative to the handle, the first and second fractional module components joined together in the assembled module by threaded fasteners received in cooperating passageways provided in the first and second fractional module components.

11. The module of claim 10 wherein a space is provided between the cooperating passageways for a module-to-handle threaded fastener.

12. A module for mounting on the end of a handle of a coating material dispensing device comprising at least a coating material fitting for coupling to a source of coating material, a first fractional module component and a second fractional module component, the coating material fitting captured between the first fractional module component and the second fractional module component when the first and second fractional module components are assembled together, each of the first and second fractional module components includes a tongue and a groove configured to receive the tongue in the assembled module.

13. The module of claim 12 wherein each of the first and second fractional module components includes a first pocket complementarily configured to receive the coating material fitting in the assembled module.

14. The module of claim 13 further including a compressed gas fitting, each of the first and second fractional module components including a first pocket complementarily configured to receive the coating material fitting and a second pocket complementarily configured to receive the compressed gas fitting in the assembled module.

15. The module of claim 14 wherein both the coating material fitting and the compressed gas fitting comprise metallic fittings, the first and second fractional module components are assembled together with metallic fasteners, the module further including a third pocket provided in at least one of the first and second fractional module components to accommodate an electrically conductive device for connecting to the metallic fittings and metallic fasteners by at least one of pressing of the electrically conductive device into intimate contact with the metallic fittings and metallic fasteners and electrical conductors extending between the electrically conductive device and the metallic fittings and metallic fasteners.

16. The module of claim 15 further including a length of grounded conduit coupled to the compressed gas fitting for coupling to ground to ground the electrically conductive device and the metallic fittings and metallic fasteners coupled to the electrically conductive device.

17. The module of claim 14 further including a generator having a shaft, and a compressed gas driven turbine wheel mounted on the shaft for driving the generator.

18. The module of claim 17 further including a passageway provided in at least one of the first and second fractional module components to supply compressed gas to the turbine wheel to drive the generator to produce electricity for the coating material dispensing device.

19. The module of claim 12 further including a generator having a shaft, and a compressed gas driven turbine wheel mounted on the shaft for driving the generator.

20. The module of claim 19 further including a passageway provided in at least one of the first and second fractional module components to supply compressed gas to the turbine wheel to drive the generator to produce electricity for the coating material dispensing device.

* * * * *